US006636006B2

(12) United States Patent
Usami

(10) Patent No.: US 6,636,006 B2
(45) Date of Patent: Oct. 21, 2003

(54) DEFLECTION YOKE WITH MULTIPLE PAIRS OF VERTICAL COILS AND SWITCHED DEFLECTION CURRENT

(75) Inventor: Yoshihiko Usami, Greensburg, PA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 6 days.

(21) Appl. No.: 10/008,400

(22) Filed: Dec. 6, 2001

(65) Prior Publication Data

US 2003/0107334 A1 Jun. 12, 2003

(51) Int. Cl.[7] ..... H01J 29/70
(52) U.S. Cl. ..... 315/399; 315/368.26
(58) Field of Search ..... 315/368.26, 399

(56) References Cited

U.S. PATENT DOCUMENTS 4,441,057 A * 4/1984 Wrona ..... 315/368.12
5,142,205 A 8/1992 Yabase et al. ..... 315/368.26
5,838,099 A 11/1998 Hichiwa et al. ..... 313/440
6,201,360 B1 * 3/2001 Misonou ..... 315/400

* cited by examiner

*Primary Examiner*—David Vu
(74) *Attorney, Agent, or Firm*—Mayer Fortkort & Williams, PC; Michael P. Fortkort, Esq.

(57) ABSTRACT

A deflection yoke for use in a cathode ray tube includes a switching circuit, which is coupled to each vertical coil. The deflection yoke employs two pairs of vertical coils. The vertical coil pairs can be two pairs of saddle type coils, one pair of saddle type coils and one pair of toroidal type coils, or a divided pair of saddle type coils to make two pairs of saddle type coils. The deflection in the first quarter region from the top and the last quarter region at the bottom of the CRT screen is provided by one coil when energized by the vertical deflection current switched through it. The deflection in the two middle quarter regions of the CRT screen is provided by a second coil when energized by the vertical deflection current switched through it. One vertical coil pair is optimized to correct convergence error in the top and bottom quarter portions of the CRT screen. The other vertical coil pair is optimized to correct convergence error in the middle portion of the CRT screen.

24 Claims, 11 Drawing Sheets

FIG. 3(c)
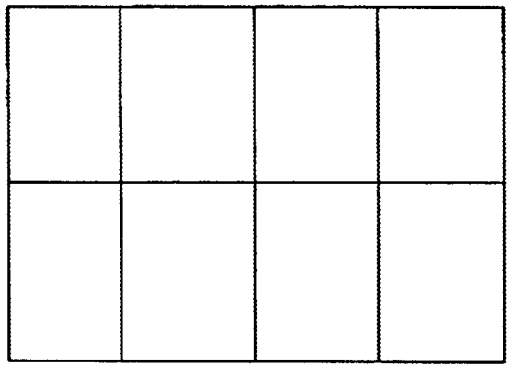
NO DISTORTION
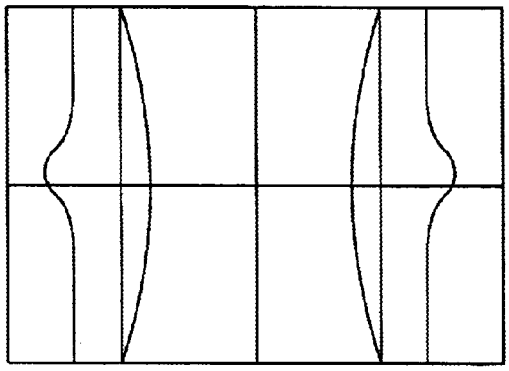
DISTORTED
FIG. 3(d)
FIG. 4(a)
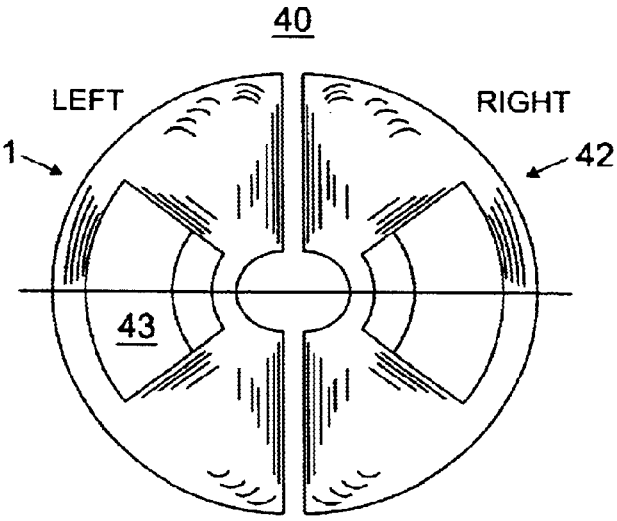
VIEW OF FRONT
SADDLE TYPE VERTICAL COIL

SADDLE TYPE VERTICAL COIL

2 COILS (SADDLE)

1 COIL DIVIDED 2 PIECES

SADDLE COIL + TOROIDAL COIL

2 COILS (TOROIDAL)

VERTICAL DEFLECTION CURRENT FLOW INTO L1
DURING t1 THROUGH t2 AND t3 THROUGH t4.

VERTICAL DEFLECTION CURRENT FLOW INTO L2 DURING t2 THROUGH t3.

DEFLECTION YOKE WITH MULTIPLE PAIRS OF VERTICAL COILS AND SWITCHED DEFLECTION CURRENT

FIELD OF THE INVENTION

The present invention relates generally to methods and apparatuses for controlling electron beams of cathode ray tubes, and more particularly to a method and apparatus for controlling an electron beam in a cathode ray tube by using a deflection yoke.

BACKGROUND

An important aspect of performance for a television monitor is its ability to correctly align the individual color components of the electron beam (e.g., for a three beam electron gun—red, green, and blue). Convergence (or mis-convergence) describes how far apart the three electron beams spread from one another within a given pixel. Ideally, the electron beam strikes all three dots in the group without hitting any adjacent groups. Mis-convergence is a quantitative measurement of the lack of convergence of the three electron beams. A CRT with significant mis-convergence will display an image with a shadowy appearance, which can be distracting to viewers.

Typically, a deflection yoke is used to control the convergence of the electron beams (e.g., red, green and blue for a three beam system) in a cathode ray tube (CRT) by changing the winding distribution in horizontal and vertical coils to compensate for mis-convergence. For example, U.S. Pat. No. 5,838,099 discloses one such deflection yoke.

Today, customers prefer televisions with ever increasing screen sizes, wider deflection angles and flatter screen faces. These developments increase the difficulty to adjust for mis-convergence using conventional methods. Usually, mis-convergence error remains near the middle of the CRT screen. To correct for this, some have employed a dedicated correction device for use with the deflection yoke. For example, U.S. Pat. No. 5,142,205 discloses a deflection yoke having a correction circuit for correcting horizontal and vertical mis-convergence. This technique requires additional electronic components, thereby increasing the parts and assembly costs of the CRT and as well as increasing the overall dimensions of the resulting device.

There are several parameters used to quantify mis-convergence, which parameters are known as convergence parameters. FIGS. 1A–E depict mis-convergence patterns YH, VCR, PQV, S2V and S3V, respectively. These FIGS. 1A–E show the plus patterns. The dotted and solid lines ideally would lie on top of each other. Mis-convergence exists when these lines do not line up. Thus, in FIG. 1A, the red and blue lines fail to overlap. The same is true for the other FIGS. 1B–E, which represent various mis-convergence parameters. These are key parameters for vertical coils.

Normally, mis-convergences are reduced by the deflection yoke itself on the CRT. In some cases, there remain mis-convergence errors as shown in FIGS. 2A–B. FIG. 2A depicts the mis-convergence patterns prior to any adjustment. FIG. 2B depicts the mis-convergence patterns after adjustment by the vertical coils of the deflection yoke. As can be seen in FIG. 2B, there remains some mis-convergence, particularly of the S2V type. Finally, applying the correction device removes this remaining mis-convergence, as shown in FIG. 2C.

Generally, adjusting the mis-convergence about the edge of the Y-axis and each corner is performed by modification of the vertical coil by making the barrel magnetic field a bit stronger than otherwise necessary. FIGS. 2D–E depict the magnetic field created by the horizontal coil (e.g., a pin-cushion magnetic field) and the vertical coil (e.g., a barrel magnetic field), respectively. But there remains mis-convergences outside the above area, especially near the middle of CRT screen, which mis-convergence parameters are called S2V and S3V. These two parameters can be adjusted by using high harmonic magnetic fields elements. On the other hand, the edge of the Y-axis and corner parameter, YH and PQV, respectively, can be adjusted by using low harmonic magnetic field elements (e.g., pin/barrel magnetic field element). Previously, adjusting S2V and S3V convergence error has been accomplished by the use of a correction device placed on the deflection yoke. But there remains distorted correction due to the magnetic field created around the correction device. To correct convergence error (S2V and S3V) perfectly causes side effects for the other mis-convergence parameters. It is necessary to modify the deflection circuit and to adjust another component (e.g., horizontal linearity, geometry and so forth). See FIGS. 3A–D.

The present invention is therefore directed to the problem of developing a method and apparatus for correcting correct mis-convergence error in the middle of the CRT screen, yet which method and apparatus expand the ability to perform fine-tuning and parameter correction of a linear pattern without the need for a separate correction device, and which is applicable to both types of vertical coil configurations—saddle type and toroidal type.

SUMMARY OF THE INVENTION

The present invention solves these and other problems by providing two pairs of vertical coils on the deflection yoke and a timing circuit that energizes the two pairs at appropriate times so that one pair of vertical coils can be optimized to control convergence for a particular region of the screen, while the other pair of vertical coils can be optimized for a different region of the screen.

For example, one pair of vertical coils can be optimized to correct mis-convergence often found at the edges of the screen, which pair of coils is then energized with a deflection current when the electron beam is pointing at the edge regions for which the coils are optimized. The second pair of vertical coils can then be optimized to correct mis-convergence often found in the middle of the screen, which pair of coils is then energized with the deflection current when the electron beam is pointing at the middle of the screen for which the second pair of coils is optimized.

BRIEF DESCRIPTION OF THE DRAWINGS;

FIGS. 3C–D depict the vertical linearity patterns before and after application of the correction device, respectively, according to a prior art implementation.

FIG. 4A depicts a view of the front of an exemplary embodiment of a saddle type vertical deflection coil according to one aspect of the present invention.

DETAILED DESCRIPTION

It is worthy to note that any reference herein to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

The embodiments of the present invention enable correction of mis-convergence error in the middle of the CRT screen without requiring a dedicated correction device. The present invention expands the ability to perform fine-tuning and parameter correction of a linear pattern without the need for a correction device.

The embodiments of the present invention are effective for two types of vertical coils—saddle type (mold die's winding and section winding) and toroidal type.

The present invention corrects S2V and S3V mis-convergences without a correction device; hence there is no side effect. According to an exemplary embodiment of the present invention, there are two pairs of vertical coils (known as V coils) used in the deflection yoke. In a saddle type system (e.g., deflection yoke standard position), there is a V coil on each side—left 41 and right 42 (see FIG. 4A). In a toroidal type system, there is a deflection yoke core with a winding on each side—top and bottom (see FIG. 4F). So both types of vertical coils (saddle and toroidal) have two vertical coils, for a total of four coils.

According to one aspect of the present invention a switching circuit 60 (see FIG. 5B) is connected to each vertical coil (L1, L2) 61, 62 to switch vertical deflection current flow into each vertical coil (L1 or L2) during deflection of the electron beam on a particular portion of CRT screen. The switch 63 opens and closes according to the timing diagram shown in FIG. 5A. The timing of this circuit depends on the exact timing of the electron beam, however, when the beam is impinging on the screen in certain areas, as defined below, one coil (L1 or L2) is energized with the deflection current while the other coil (L2 or L1, respectively) is not, and when the beam is impinging on the screen in other areas the other coil (L2 or L1, respectively) is energized with the deflection current while the one coil (L1 or L2) is not.

Figure 1A:
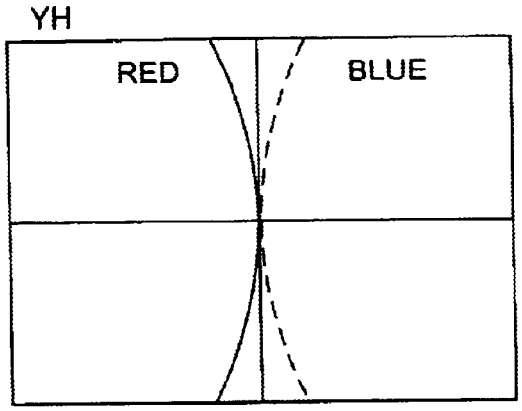
FIGS. 1A–E depict various mis-convergence patterns on a cathode ray tube.
Figure 1B:
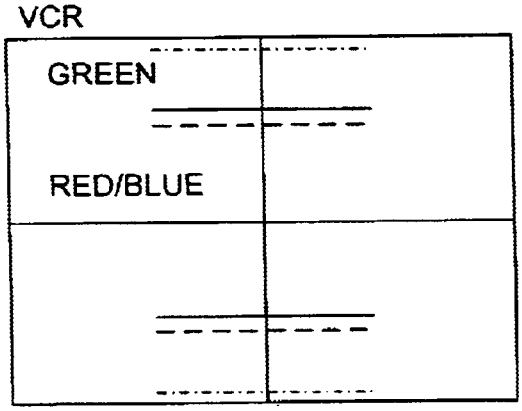
Figure 1C:
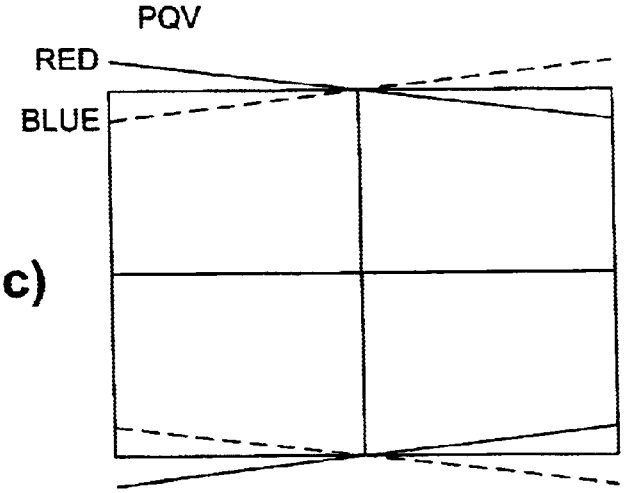
Figure 1D:
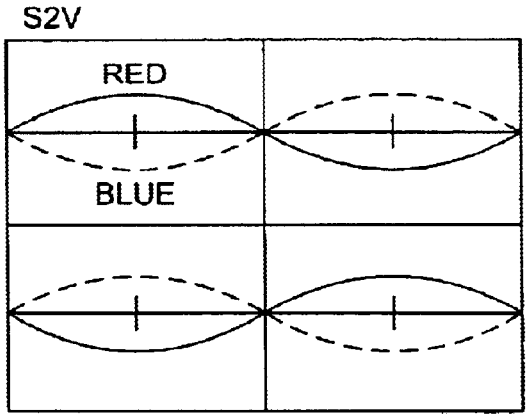
Figure 1E:
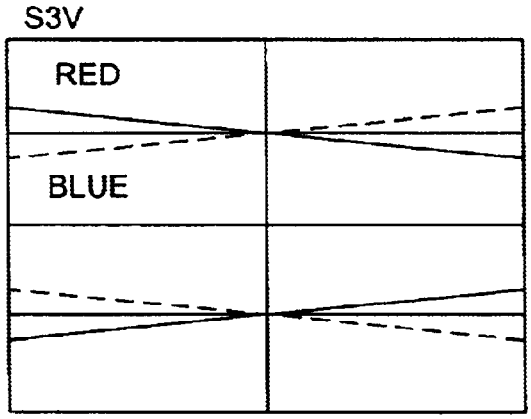
Figure 2A:
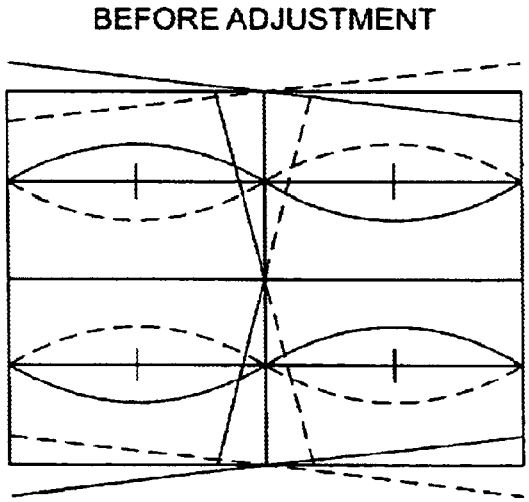
FIGS. 2A–B depict various mis-convergence patterns before and after, respectively, adjustment by the vertical coil according to a prior art implementation.
Figure 2B:
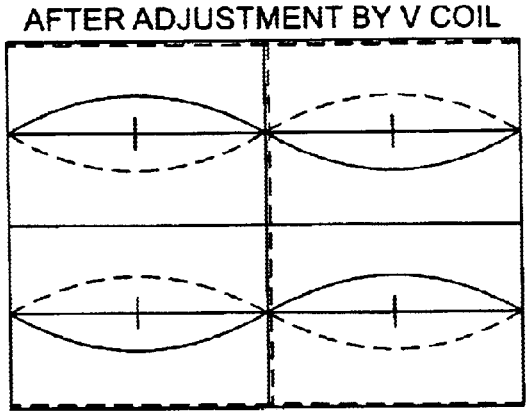
Figure 2C:
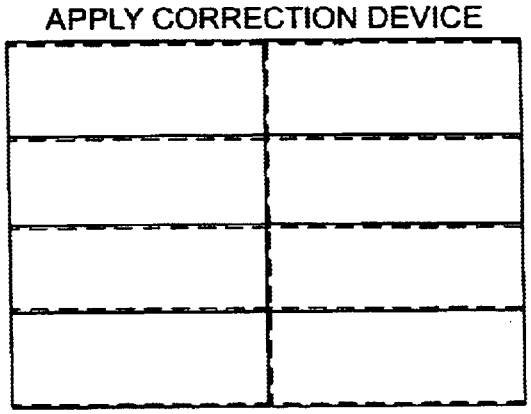
FIG. 2C depicts the mis-convergence patterns of FIG. 2B after application of the correction device according to a prior art implementation.
Figure 2D:
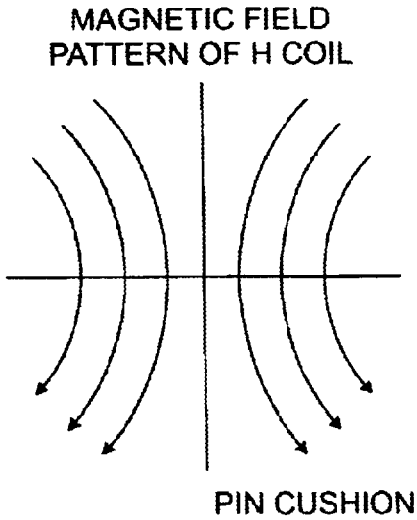
FIG. 2D depicts a magnetic field resulting from the horizontal coil of the deflection yoke.
Figure 2E:
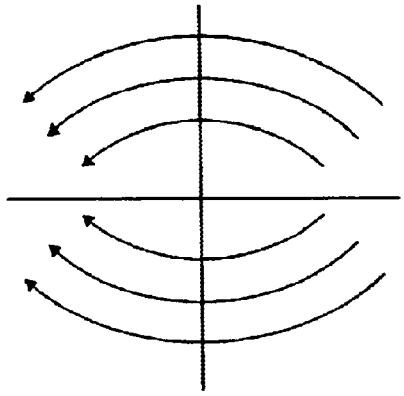
FIG. 2E depicts a magnetic field resulting from the vertical coil of the deflection yoke.
Figure 3A:
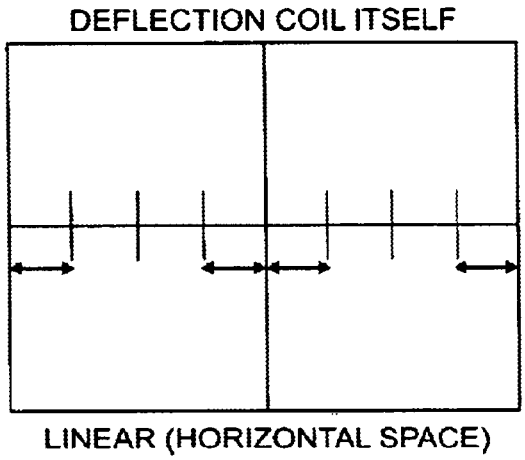
FIGS. 3A–B depict the horizontal linearity patterns before and after application of the correction device, respectively, according to a prior art implementation.
Figure 3B:
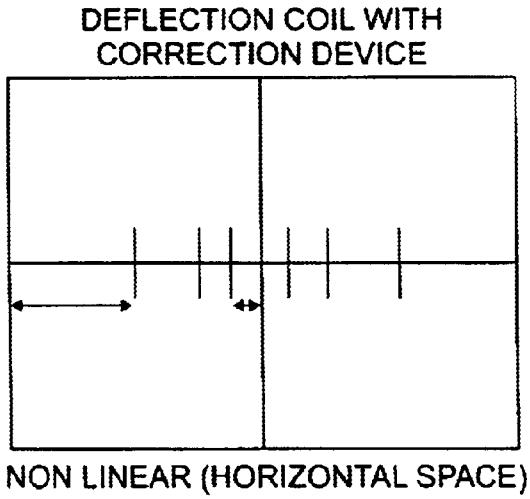
Figure 4B:
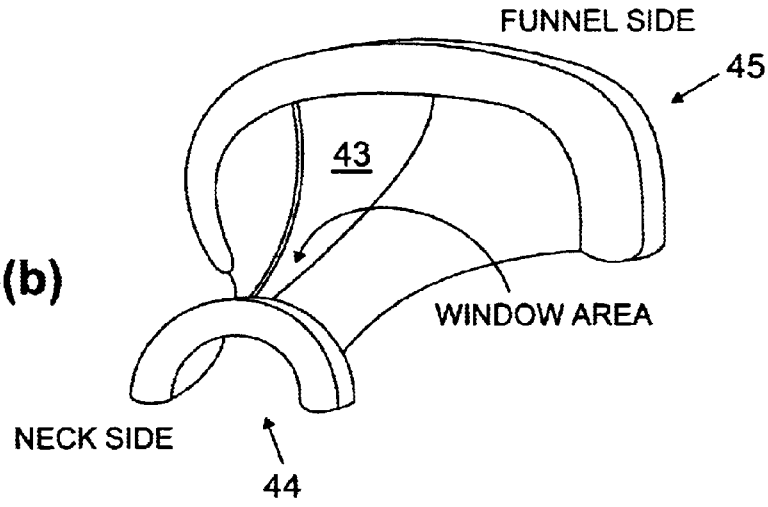
FIG. 4B depicts a view of the neck side of an exemplary embodiment of a saddle type vertical deflection coil according to another aspect of the present invention.

There are several possible embodiments of the coils (L1 and L2). FIGS. 4A–B show the general configuration 40 of a vertical coil in a front view and a neck view, respectively. Typically, there is a left coil 41 and a right coil 42. A saddle type vertical coil includes a neck side 44 and a funnel side 45. A window area 43 is where no coils are disposed. FIGS. 4C–F show the shape of each type of vertical coils according to several aspects of the present invention.

Figure 4C:
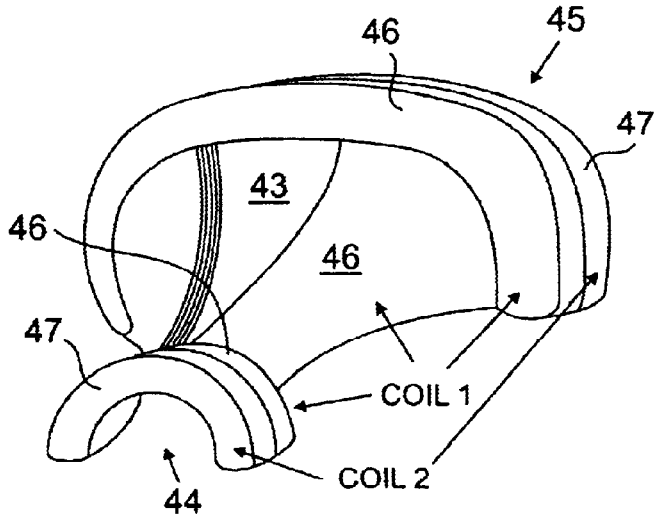
FIG. 4C depicts a neck side view of a dual coil embodiment of a saddle type vertical deflection coil according to yet another aspect of the present invention.

FIG. 4C shows two coils of a saddle type configuration according to one aspect of the present invention. In this embodiment, the coil at the neck side 44 is split into two coils 46, 47 and the coil at the funnel side 45 is split into two coils 46, 47. Thus, coil 1 (L1) is the interior one 46 of the two coil pairs, whereas coil 2 (L2) is the exterior one 47 of the two coil pairs 46, 47.

Figure 4D:
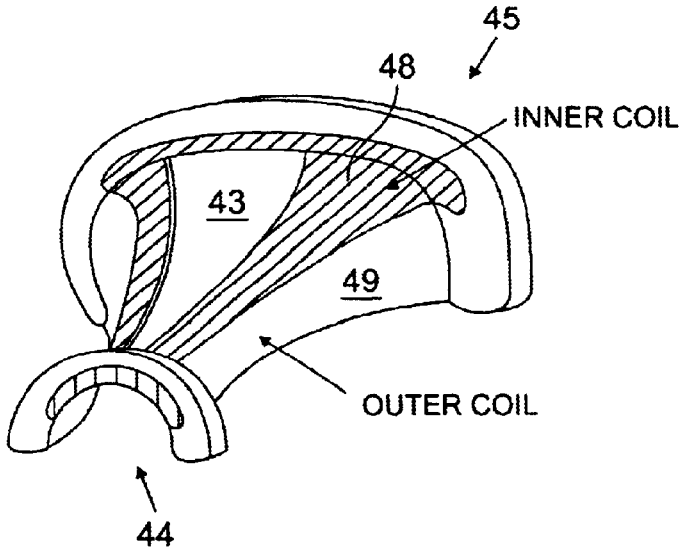
FIG. 4D depicts a neck side view of a single divided coil embodiment of a saddle type vertical deflection coil according to still another aspect of the present invention.

FIG. 4D shows one coil of a saddle type coil system that is divided into-two coils (an inner coil 48 and an outer coil 49). In this embodiment, the coil is split into an inner coil 48 and an outer coil 49. The inner coil 48 surrounds the window area 43 of the deflection yoke, and the outer coil 49 fills in the remaining area.

Figure 4E:
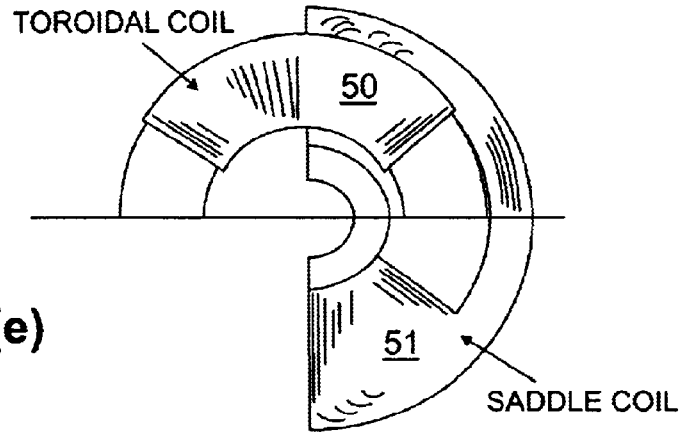
FIG. 4E depicts a neck side view of a saddle coil and torroidal coil combination embodiment of a vertical deflection coil according to yet another aspect of the present invention.

FIG. 4E shows two coils—a combination of saddle type and toroidal type. In this embodiment, there is a toroidal coil 50 on the top portion and a saddle coil 51 on the bottom portion. Of course, these could be switched, as the device is symmetric.

Figure 4F:
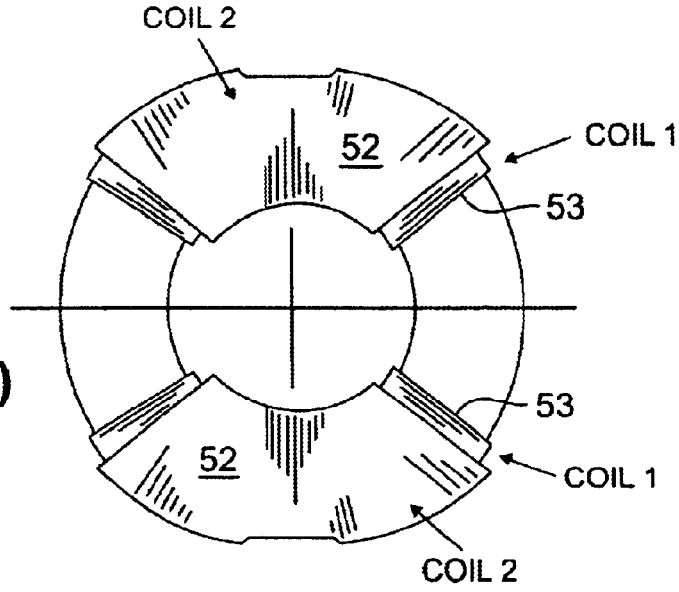
FIG. 4F depicts a neck side view of a dual toroidal coil embodiment of a vertical deflection coil according to still another aspect of the present invention.

FIG. 4F shows-two coils of toroidal type (e.g., in this case it comprises a double winding on the deflection yoke core). In this embodiment, the coil is split into a first coil 53 that surrounds the window area, and a second coil 52 that fills in the remaining area between.

Figure 5A:
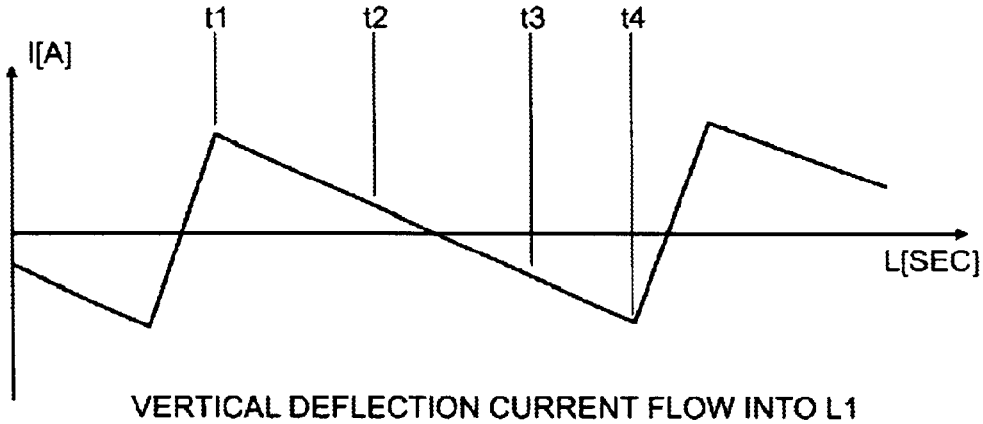
FIG. 5A depicts a timing diagram of an exemplary embodiment of a vertical deflection current flow according to yet another aspect of the present invention.

FIG. 5A shows the vertical deflection current wave shape and its associated timing. Beginning at the start of the current pulse t1, the current is at a maximum and slowly linearly decays to its minimum at t4. The pulse then repeats. The start of the pulse occurs when the electron beam is focused on the edge of the screen (e.g., a top or bottom extreme position). The end of the pulse occurs when the electron beam is focused on the opposite edge of the screen from where it started (e.g., the bottom or top extreme position). The point at which the current crosses the y-axis should occur when the electron beam is focused in the middle of the CRT screen.

Figure 5B:
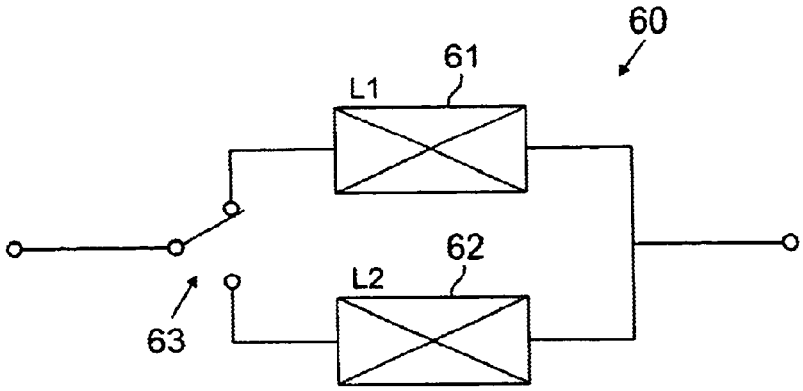
FIG. 5B depicts an exemplary embodiment of a switching circuit for implementing the timing diagram in FIG. 5A according to yet another aspect of the present invention.

FIG. 5B shows a block diagram of a circuit 60 to implement the switching. Basically, a switch 63 causes current to flow into coil 1 (L1) during a first period, and then switches to energize coil 2 (L2) during a second period and then back to coil 1 during a third period. During a first time period from t1 through t2 the deflection current flows through coil L1, in which case coil L1 operates to deflect the electron beam when impinging on the screen from the top (or one extreme) of the screen to about ¼ from the top of CRT screen. During a second time period from t2 through t3, the deflection current flows through coil L2, in which case coil L2 operates to deflect the electron beam when impinging on the middle area of the CRT screen (e.g., between about ¼ from the top, or extreme, and ¾ from the top, or extreme). During a third time period from t3 through t4, the deflection current flows through coil L1, which operates to deflect the electron beam when impinging on the bottom area of the CRT screen (e.g., between about ¾ from the top, or extreme and the bottom, or other extreme end of the screen). This timing is controlled by a switching circuit.

The timing circuit could be controlled by a programmable switch, such as a processor, or by a combination of transistors whose timing is set by resistors and capacitors in the usual manner.

Figure 5C:
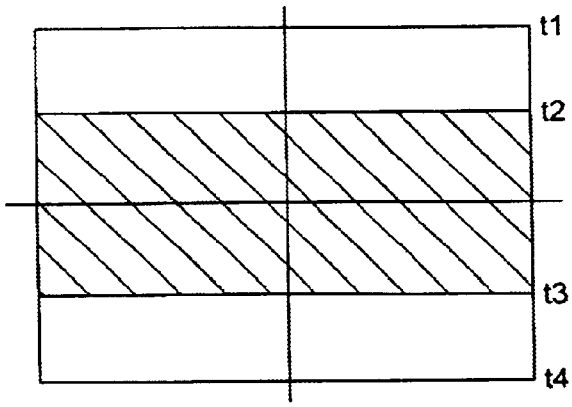
FIG. 5C depicts relationship of the timing in FIG. 5A and the location of the electron beam on the CRT screen according to one aspect of the present invention.

FIG. 5C depicts the relationship of the screen area to the timing points t1, t2, t3 and t4. Roughly, these points exist at-the edges and ¼ of the screen height (or width) to divide the screen into two roughly equivalent portions whose deflection is controlled by a different vertical coil.

Figure 6A:
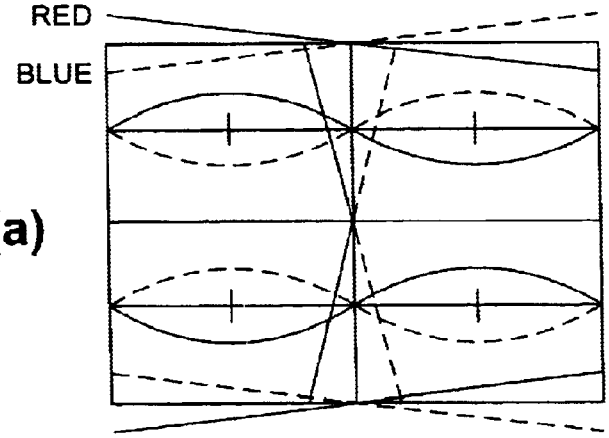
FIGS. 6A–B and 6D–E depict various mis-convergence patterns on a cathode ray tube after implementing one or more embodiments of the present invention.
Figure 6B:
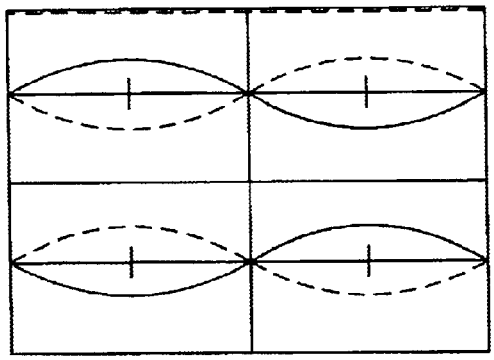

We now describe the vertical coil itself. For example, in the saddle type embodiment, simply put, one coil would be divided into two coils. In this embodiment, there are mis-convergence errors as shown in FIG. 6A—YH=+, PQV=+, S2V=+, S3V=+. Normally, one would reduce these mis-convergences by the barrel magnetic field output from the vertical coil, which would drive this mis-convergence to zero. However, as explained above, the edge of the Y-axis and the corner convergence error are easy to correct. But there remains S2V and S3V mis-convergence (see FIG. 6B).

Figure 6C:
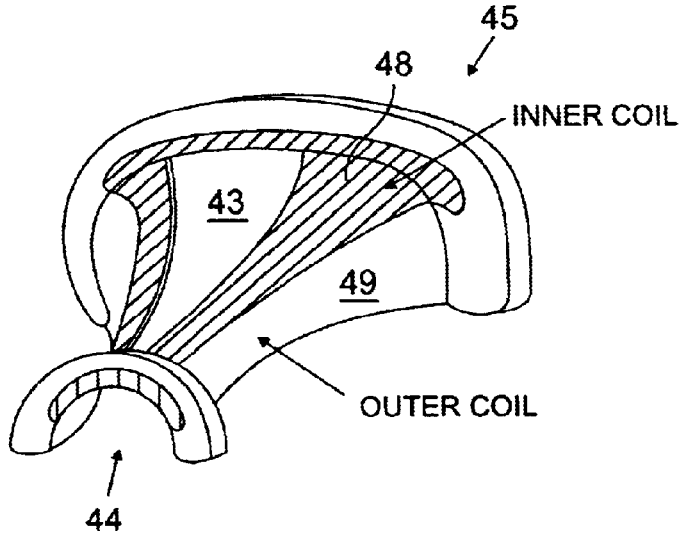
FIG. 6C depicts a neck side view of a vertical deflection coil according to still another aspect of the present invention.

But employing the embodiment of the present invention to use two pairs of vertical coils and connecting them to a switching circuit allows for correction of these errors without distortion or other side effects. First, the vertical coil magnetic field is adjusted by the outer vertical coil (see FIG. 6C) to correct convergence error in the top area (see FIG. 5C, the white area from t1 through t2) and the bottom area of CRT screen (see FIG. 5C, the white area from t3 through t4). This outer coil must be activated during t1 through t2 and during t3 through t4 with the vertical deflection current (see FIG. 5A). This reduces the mis-convergence about the edge of the Y-axis and each corner, which are YH and PQV mis-convergences.

Figure 6D:
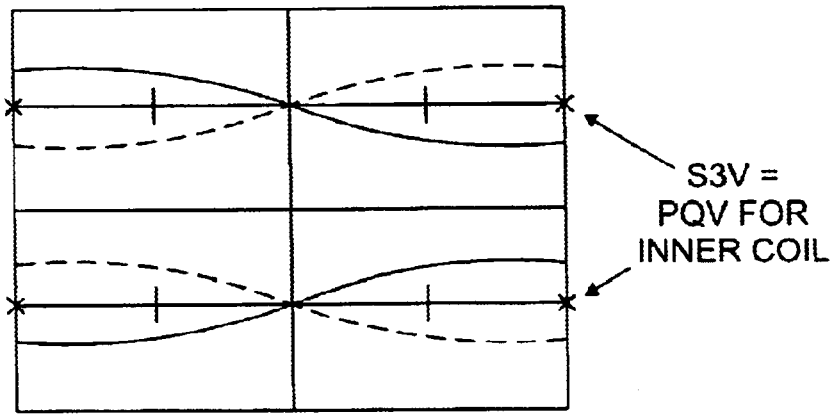

Next, the inner coil (see FIG. 6C) is used to correct other mis-convergences. This inner coil would be energized from t2 through t3 with the vertical deflection current. This occurs when the electron beam is focused on the middle of the CRT screen (see FIG. 5C, the black area). This working area looks like the edge of the Y-axis and each corner for this inner vertical coil (see FIG.6D). Thus, there remains error on the edges but not in the middle, however, since the electron beam is not focused on these portions, the error does not affect the image. Thus, it is possible to adjust the convergence error by using pin/barrel elements of the magnetic field during t2 through t3 due to the timing of the deflection current. The actual viewing portion of the CRT screen includes S2V and S3V mis-convergence, but S2V and S3V are almost equal the PQV and YH parameter for the inner vertical coil.

Figure 6E:
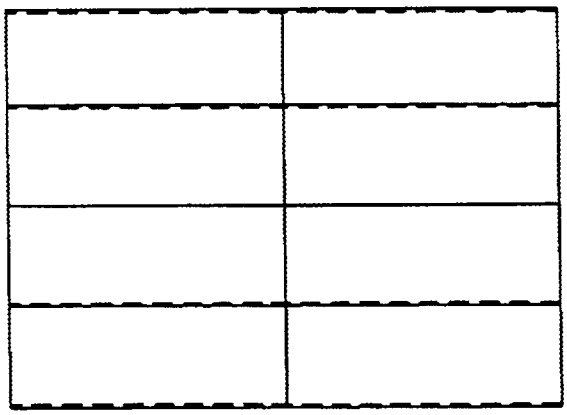

Finally, it is possible to correct convergence error of the type PQV, YH, S2V and S3V by this vertical coil (inner vertical coil and outer vertical coil). See FIG. 6E.

The basic principle uses the magnetic field of the Pin/Barrel type output by the deflection coils, which does not use high harmonic magnetic field elements. In other words, there are two pairs of vertical coils. Each pairs performance would be optimized to output a pin/barrel magnetic field for a particular region of the CRT screen (top and bottom area or middle area of CRT screen) served by each pair of vertical coils.

Therefore, S2V and S3V mis-convergences are corrected by the deflection coil (i.e., the vertical coils) without requiring a correction device. Of course, the convergence error is removed without creating side effects that would emanate from a correction device.

In summary, various embodiments include a switching circuit provided in the deflection yoke, which switching circuit is coupled to each vertical coil. The deflection yoke employs two pairs of vertical coils. The pairing can be two pairs of saddle type, one pair of saddle type and one pair of toroidal type, or divided a pair of saddle type coils to make two pairs of saddle type. The deflection between the top and ¼ of the height down from the top of the CRT screen (i.e., the top quarter region) and between ¾ of the height down from the top and the bottom of the CRT screen (i.e., the bottom quarter region) is provided by one coil (L1) when energized by the vertical deflection current switched through it. The deflection from ¼ of the height down from the top and ¾ of the height down from the top of CRT screen (i.e., the middle two quarter regions) is provided by a second coil (L2) when energized by the vertical deflection current switched through it. One vertical coil pair L1 (or L2) would be optimized to correct convergence error in the top and bottom portions of the CRT screen (e.g., from the top to ¼ of the height down and from the bottom to ¾ of the height down from the top). The other vertical coil pair L2 (or L1) would be tuned to correct convergence error in the middle of the CRT screen area (e.g., between ¼ of the height down from the top through ¾ of the height down from the top).

Although various embodiments are specifically illustrated and described herein, it will be appreciated that modifications and variations of the invention are covered by the above teachings and are within the purview of the appended claims without departing from the spirit and intended scope of the invention. Furthermore, these examples should not be interpreted to limit the modifications and variations of the invention covered by the claims but are merely illustrative of possible variations.

What is claimed is:

1. A method for correcting for mis-convergence error in a cathode ray tube comprising:

coupling a switching circuit to a first vertical coil of a deflection yoke and coupling the switching circuit to a second vertical coil of the deflection yoke;

coupling a deflection current through first coil when an electron bean of the cathode ray tube is currently pointing in a first region of a screen of the cathode ray tube; and coupling the deflection current through a second coil when the electron beam of the cathode ray tube is currently pointing in a second region of the screen of the cathode ray tube.

2. The method according to claim 1, wherein the first region includes a top quarter region of the screen.

3. The method according to claim 2, wherein the first region includes a bottom quarter region of the screen.

4. The method according to claim 1, wherein the second region includes a middle half region of the screen.

5. The method according to claim 1, further comprising coupling zero current through the first coil when coupling the deflection current through the second coil.

6. The method according to claim 1, further comprising coupling zero current through the second coil when coupling the deflection current through the first coil.

7. A method for correcting for mis-convergence error in a cathode ray tube comprising:

switching a deflection current through first coil when an electron beam of the cathode ray tube is currently pointing in an edge region of a screen of the cathode ray tube; and coupling the deflection current through a second coil when the electron beam of the cathode ray tube is currently pointing in a middle region of the screen of the cathode ray tube.

8. The method according to claim 7, wherein the edge region includes a top quarter region of the screen.

9. The method according to claim 8, wherein the edge region includes a bottom quarter region of the screen.

10. The method according to claim 7, wherein the middle region includes the middle two quarter regions of the screen.

11. The method according to claim 7, further comprising switching zero current through the first coil when switching the deflection current through the second coil.

12. The method according to claim 7, further comprising switching zero current through the second coil when switching the deflection current through the first coil.

13. A deflection yoke for use in a cathode ray tube for correcting for mis-convergence error comprising:

a first pair of vertical coils being optimized to correct mis-convergence error related to a first particular region of a screen of the cathode ray tube;

a second pair of vertical coils being optimized to correct mis-convergence error related to a second particular region of the screen of the cathode ray tube; and a deflection current circuit coupled to the first and second pairs of vertical coils, switching a deflection current through the first pair of vertical coils during a first time period and switching the deflection current through the second pair of vertical coils during a second time period.

14. The deflection yoke according to claim 13, wherein the first time period occurs when an electron beam of the cathode ray tube is pointed at the first particular region.

15. The deflection yoke according to claim 14, wherein the second time period occurs when an electron beam of the cathode ray tube is pointed at the second particular region.

16. The deflection yoke according to claim 13, wherein the first particular region includes two edge regions.

17. The deflection yoke according to claim 13, wherein the second particular region includes a middle region.

18. The deflection yoke according to claim 13, wherein the first pair of vertical coils includes two saddle type coils, one disposed on a neck side of the deflection yoke and another disposed on a funnel side of the deflection yoke.

19. The deflection yoke according to claim 18, wherein the second pair of vertical coils includes two saddle type coils, one disposed on thee neck side of the deflection yoke adjacent to one of the first pair of vertical coils and another disposed on the funnel side of the deflection yoke adjacent to the other one of the first pair of vertical coils.

20. The deflection yoke according to claim 13, wherein the first pair of vertical coils includes an inner coil disposed around a window region of the deflection yoke, and the second pair of vertical coils includes an outer coil disposed adjacent to the inner coil.

21. The deflection yoke according to claim 13, wherein the first pair of vertical coils includes a toroidal coil and the second pair of vertical coils includes a saddle coil.

22. The deflection yoke according to claim 13, wherein the first pair of vertical coils includes an inner toroidal coil disposed adjacent to a window region of the deflection yoke and the second pair of vertical coils includes an outer toroidal coil disposed adjacent to the inner toroidal coil of the first pair of vertical coils.

23. An apparatus for controlling convergence of an electron beam in a cathode ray tube comprising:

a first plurality of coils optimized to correct for convergence errors related to a first region of a screen of the cathode ray tube and activated when an electron beam of the cathode ray tube is currently pointing in the first region of the screen of the cathode ray tube; and a second plurality of coils optimized to correct for convergence errors related to a second region of the screen of the cathode ray tube and activated when an electron beam of the cathode ray tube is currently pointing in the second region of the screen of the cathode ray tube.

24. An apparatus for controlling convergence of an electron beam in a cathode ray tube comprising:

a first plurality of coils optimized to correct for convergence errors related to a first region of a screen of the cathode ray tube;

a second plurality of coils optimized to correct for convergence errors related to a second region of the screen of the cathode ray tube; and a timing circuit to control activation of the first and second plurality of coils in accordance with a location on the screen in which the electron beam is currently pointing.

* * * * *

UNITED STATES PATENT AND TRADEMARK OFFICE

CERTIFICATE OF CORRECTION

PATENT NO. : 6,636,006 B2
DATED : October 21, 2003
INVENTOR(S) : Yoshihiko Usami It is certified that error appears in the above-identified patent and that said Letters Patent is hereby corrected as shown below:

Column 6,
Line 49, after “electron” change “bean” to -- beam --.

Column 8,
Line 5, after “on”, change “thee” to -- the --.

Signed and Sealed this

Sixteenth Day of December, 2003

JAMES E. ROGAN
*Director of the United States Patent and Trademark Office*